US005601140A

United States Patent [19]

Praeg

[11] Patent Number: 5,601,140

[45] **Date of Patent: *Feb. 11, 1997**

[54] APPARATUS FOR EFFICIENT SIDEWALL CONTAINMENT OF MOLTEN METAL WITH HORIZONTAL ALTERNATING MAGNETIC FIELDS UTILIZING A FERROMAGNETIC DAM

[75] Inventor: Walter F. Praeg, Palos Park, Ill.

[73] Assignee: ARCH Development Corporation, Chicago, Ill.

[ * ] Notice: The term of this patent shall not extend beyond the expiration date of Pat. No. 4,936,374.

[21] Appl. No.: 381,717

[22] Filed: Jan. 31, 1995

Related U.S. Application Data

[63] Continuation-in-part of Ser. No. 952,519, Jul. 23, 1993, Pat. No. 5,385,201.

[51] Int. Cl.[6] ..... B22D 27/02; B22D 11/04

[52] U.S. Cl. ..... 164/503; 164/428

[58] Field of Search ..... 164/467, 503, 164/428, 480

[56] References Cited

U.S. PATENT DOCUMENTS 4,936,374 6/1990 Praeg ..... 164/503

*Primary Examiner*—Kuang Y. Lin

*Attorney, Agent, or Firm*—Reinhart, Boerner, Van Deuren, Norris & Rieselbach, s.c.

[57] ABSTRACT

An apparatus for casting sheets of metal from molten metal. The apparatus includes a containment structure having an open side, a horizontal alternating magnetic field generating structure and a ferromagnetic dam. The magnetic field and the ferromagnetic dam contain the molten metal from leaking out side portions of the open side of the containment structure.

24 Claims, 11 Drawing Sheets

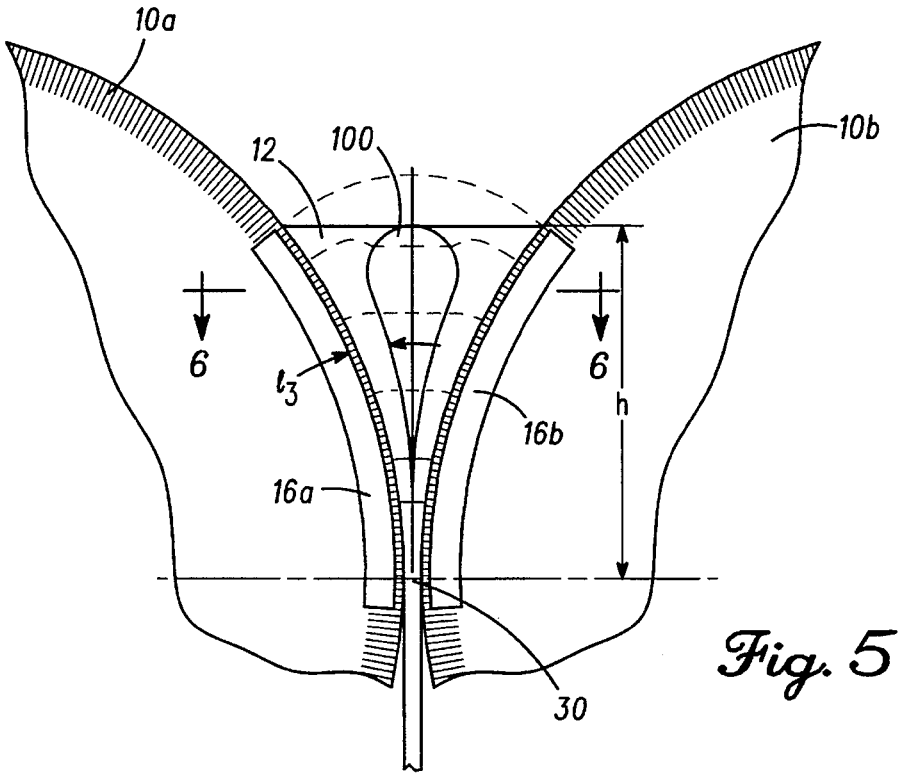
Fig. 5
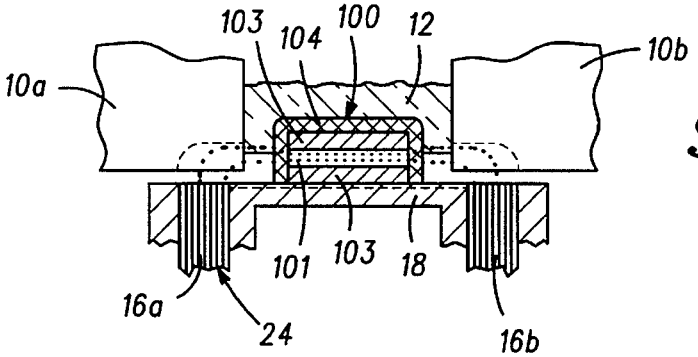
Fig. 6
Fig. 7
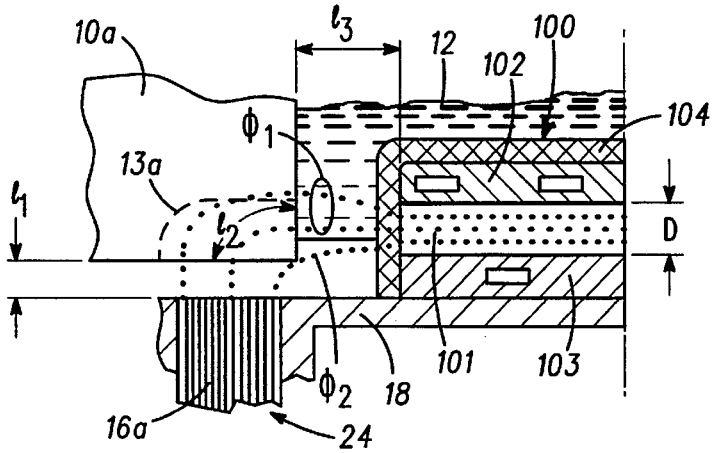

Fig. 22
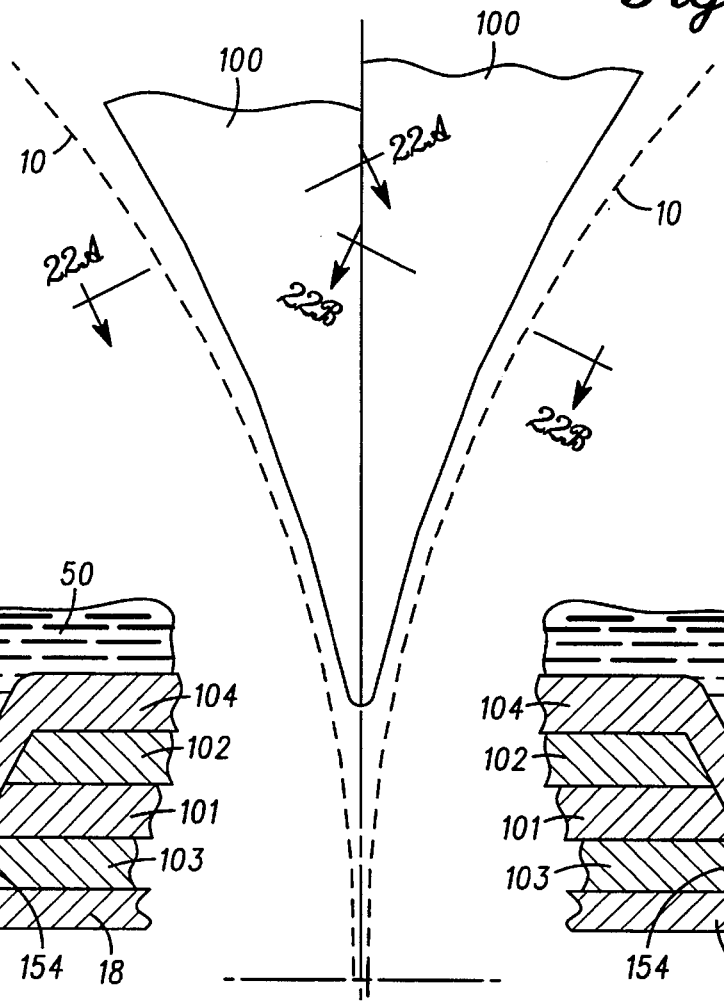
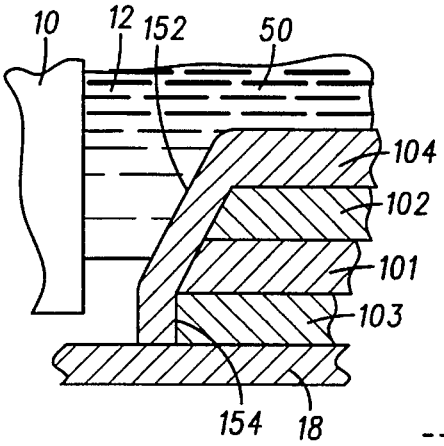
Fig. 22A
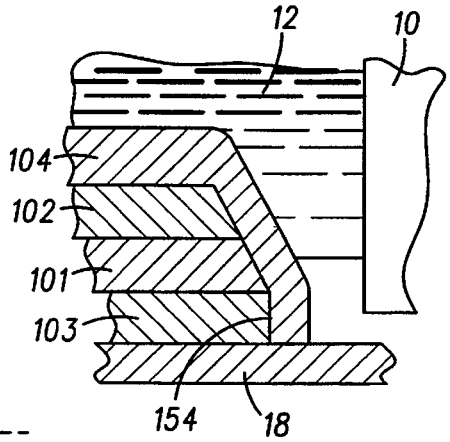
Fig. 22B
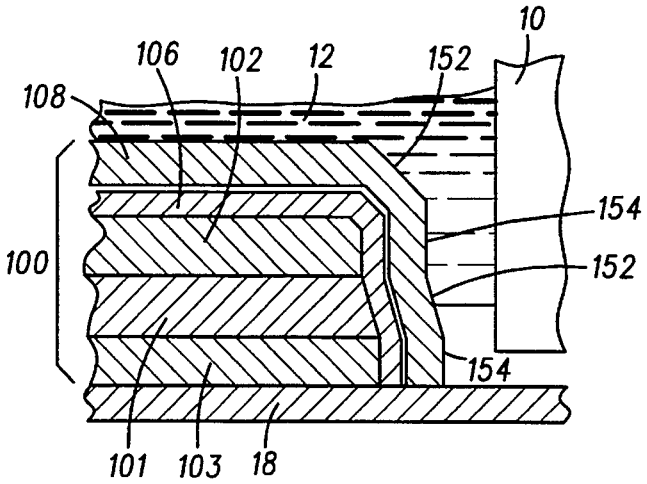
Fig. 23

APPARATUS FOR EFFICIENT SIDEWALL CONTAINMENT OF MOLTEN METAL WITH HORIZONTAL ALTERNATING MAGNETIC FIELDS UTILIZING A FERROMAGNETIC DAM

This invention was made with Government support under Contract No. W-31-109-ENG-38 awarded by the Department of Energy. The Government has certain rights in this invention.

This patent application is a continuation-in-part of U.S. patent application Ser. No. 07/952,519 filed Jul. 23, 1993 (which will issue as U.S. Pat. No. 5,385,201) and is based on a Patent Cooperation Treaty application claiming priority on U.S. Pat. No. 4,936,374.

FIELD OF THE INVENTION

The present invention generally relates to electromagnetically confining molten metal. More specifically, the present invention relates to efficiently confining molten metal near edges or other portions of substantially parallel rollers as a solid metal sheet is cast by counter-rotation of the rollers.

BACKGROUND OF THE INVENTION

Conventional twin-roller casting apparatus usually have radii (R) of greater than or equal to 50 cm and the pool of molten metal typically has a depth $h \geqq \frac{2}{3}R \geqq 33$ cm. Containment of the molten metal pool sidewalls, particularly at the rollers, is preferably accomplished using magnetomotive forces. Most of the magnetomotive force for containment of each sidewall is required at a pool depth approximately 25% below the pool surface. The magnetomotive force required for sidewall containment at that depth can be three times larger than what is required at the bottom of the pool because the flux path length is much larger than the path at the bottom of the pool. These large magnetomotive force forces require relatively large power supplies (e.g., $\geqq$500 kW) and the power losses in the sidewall of the pool of molten metal and in the magnet are correspondingly large. These power losses have been found to cause undesirable heating of the molten metal.

Accordingly it is an object of the present invention to provide an improved method and apparatus for reducing the magnetomotive force for sidewall containment when casting metal sheets.

It is another object of the present invention to provide a novel apparatus and method for containing a pool of molten metal comprising a shaped horizontal alternating magnetic field and a mechanical dam.

It is a further object of the present invention to provide an improved method and apparatus for preventing a pool of molten metal from flowing over the ends of counter-rotating rollers comprising a shaped horizontal alternating magnetic field and a ferromagnetic dam.

It is a further object of the invention to provide a novel method and apparatus that contains molten metal with a minimum of power dissipation in sidewalls of the molten metal.

It is a still further object of the invention to provide an improved method and apparatus that contains a pool of molten metal from flowing out sides of a containment means with a minimum of electrical power consumed by the containment means.

The features of the present invention which are believed to be novel are set forth with particularity in the appended claims. The invention, together with the further objects and advantages thereof, may best be understood by reference to the following description taken in conjunction with the accompanying drawings, wherein like reference numerals identify like elements.

BRIEF DESCRIPTION OF THE DRAWINGS

FIG. 5 illustrates a cross sectional front view of another form of the present invention.

FIG. 6 shows a view along line 6—6 of FIG. 5.

FIG. 7 illustrates an enlarged view of the left half of FIG. 6.

FIG. 22 illustrates a front view of two half-sections of ferromagnetic dams.

FIG. 22A illustrates a view along line A—A of FIG. 22. FIG. 22B shows a view along line B-B of FIG. 22.

FIG. 23 illustrates a front view similar to FIG. 22B showing a ferromagnetic dam with a semi-permanent refractory coat covered by a removable refractory shield.

DETAILED DESCRIPTION OF THE INVENTION

Figure 1:
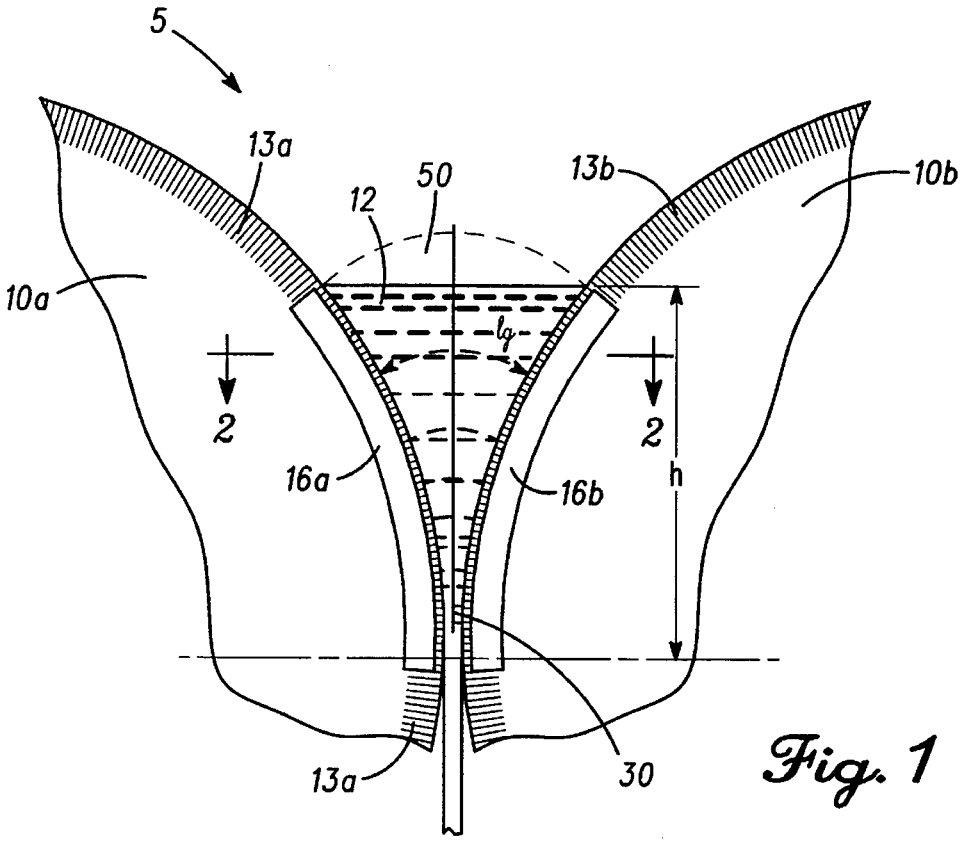
FIG. 1 illustrates a cross sectional front view of an apparatus for electromagnetic containment as described in U.S. Pat. Nos. 4,936,374 and 5,385,201.

Advantages obtained from continuous casting of metal sheets with counter-rotating rollers and electromagnetic confinement of the molten metal at the edge of the rollers are described in U.S. Pat. Nos. 4,936,374, and 5,385,201. U.S. Pat. No. 4,936,374 (particularly the figures and columns 10–11) is incorporated herein for additional detail regarding twin-roll casting apparatus and ferromagnetic dams usable therewith. These patents are parent applications of the present application, were granted to the inventor of the present invention, and are assigned to the same entity as this application.

A combination of mechanical and electromagnetic means to contain molten metal at the edges of counter-rotating rollers is described in U.S. Pat. Nos. 4,936,374 and 5,385,201. In one preferred embodiment, a dam structure is positioned between the edges of the counter-rotating rollers and a horizontal alternating magnetic field, thereby providing both mechanical and electromagnetic containment of molten metal. Space is provided between the sides of the dam structure and the counter-rotating rollers to prevent clogging of the molten metal by the solidifying effect of the cooled counter-rotating rollers. The horizontal alternating magnetic field confines the molten metal in the gaps between the dam structure and the counter-rotating rollers as described in U.S. Pat. No. 5,385,201.

In accordance with the present invention, the mechanical dam 100 can contain a core 101 of ferromagnetic material and provide a low reluctance path for alternating magnetic flux, thereby greatly reducing the energy required for electromagnetic sidewall containment. As referred to herein, "ferromagnetic" is used to refer to any and all materials having a magnetic permeability greater than that of a vacuum, i.e., having a magnetic permeability greater than one. Suitable ferromagnetic materials include laminated silicon steel, laminated metallic glass or ferrite material. The ferromagnetic material can be protected from the molten metal by methods and/or means well-known to those skilled in the art, preferably through use of water-cooled heatsinks which are covered by at least one layer of refractory material.

One containment means for the molten metal takes the form of a box having an open side at its bottom. The open side is preferably formed by two spaced members. In the most preferred embodiments of the invention the containment means comprises the rollers 10 illustrated herein in the figures. Without limitation to any one theory or explanation, it appears that electromagnetic containment of the sidewall of a pool 50 of molten metal between counter-rotating rollers 10 causes power dissipation in the sidewalls of the pool 50. The power dissipation per unit area is $$\frac{P}{A}=\frac{\rho}{2\delta}\left(\frac{B}{\mu_o}\right)^2 \quad (1)$$

where $\rho$ is the resistivity, $\delta$ the skin depth of the molten metal, B is the flux density and $\mu_o$ the permeability of free space.

Figure 3:
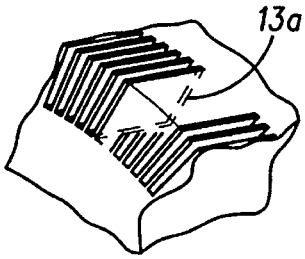
FIG. 3 illustrates low reluctance slots cut in rollers 10*a* and 10*b* of FIGS. 1 and 2.
Figure 2:
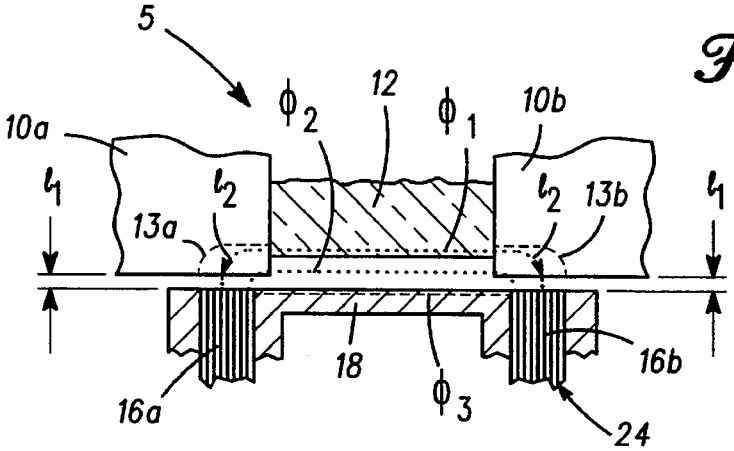
FIG. 2 shows a view along section line 2—2 of FIG. 1.

FIGS. 1 through 3 depict an apparatus for electromagnetic sidewall containment of molten metal as described in U.S. Pat. No. 4,936,374. An alternating magnetic field, produced by containment magnet 24, passes through slots 13 in the rims of rollers 10 between magnet poles 16. Horizontal flux lines $\phi_1$ penetrate the molten metal 12 of pool 50. The horizontal flux lines induce vertical eddy currents which, by interaction with part of $\phi_1$ produce an electromagnetic containment force, $F_m$, wherein $$F_m=\frac{B^2}{2\mu_o} \quad (2)$$

Flux lines $\phi_2$ in front of the sidewall of molten metal 12 do not contribute to sidewall containment. Flux lines $\phi_3$ in the copper shield 18 of the containment magnet 24 cause eddy current losses and undesirable heating.

FIG. 1 illustrates how the length of the flux path, $l_g$, increases from where the solidified metal leaves the rollers (the horizontal line where the roller 10 separation is smallest-also called the nip) up to the surface of the pool 50 of molten metal 12.

Figure 4:
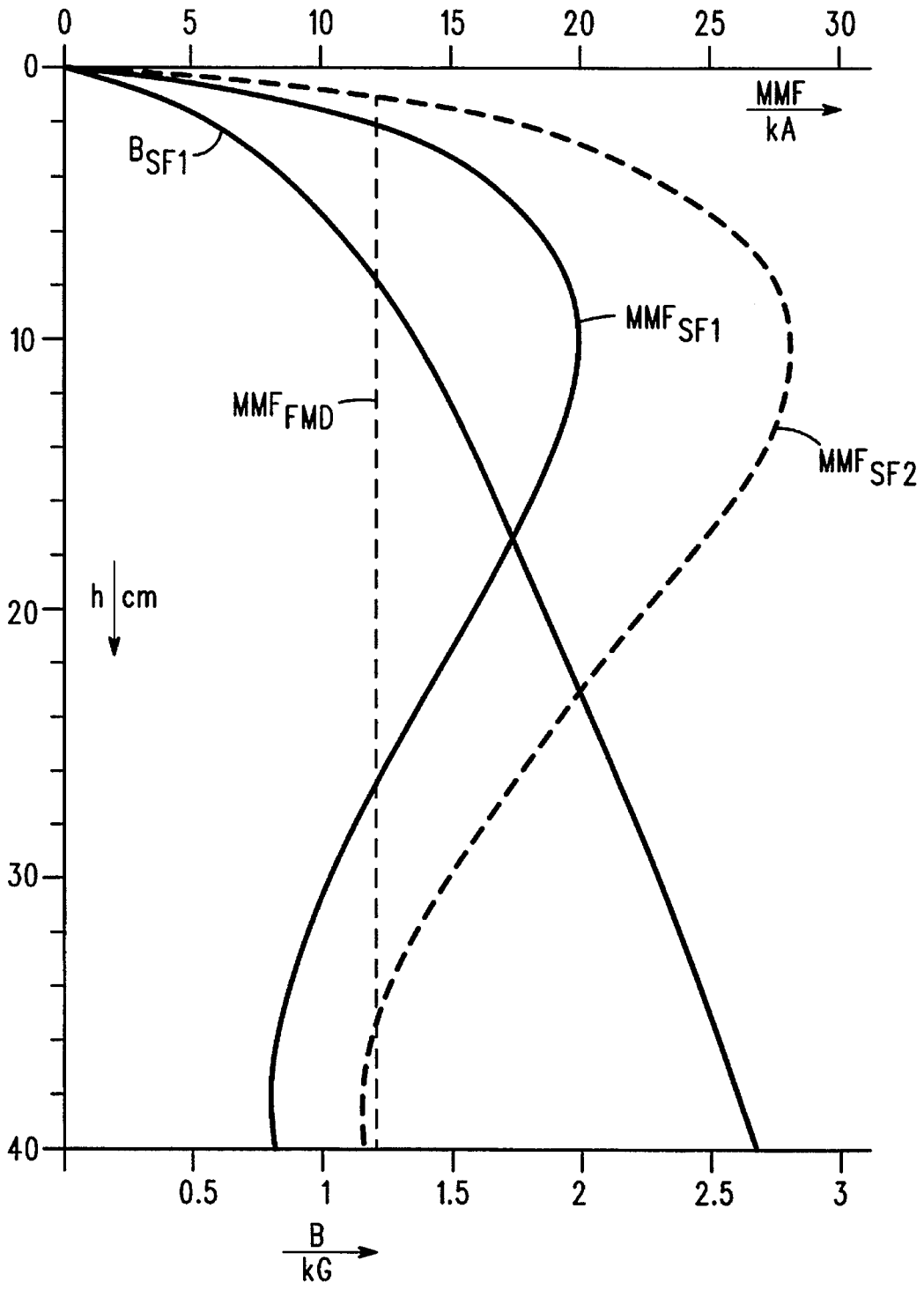
FIG. 4 shows the flux density $B_{SF1}$ required to contain the gravitational forces of a pool of molten steel together with the magnetomotive forces required to produce $B_{SF1}$, $B_{SF2}$, and the effect of the ferromagnetic dam on magnetomotive force requirements.

As described in U.S. Pat. No. 4,936,374 the magnetic field (B) required to contain the gravitational pressure, without any safety factor (SF1), is $$B_{SF1}=(2\mu_o g\xi h)^{1/2}=k_{(h)}{}^{1/2} \quad (3)$$

where $\mu_o$=the permeability of free space;

g=acceleration of gravity;

$\xi$=density of the molten metal;

h=distance from the pool surface to a point on a sidewall;

For steel k≈421 when B is measured in Gauss and h in cm. The flux density, $B_{SF1}$ required to balance the gravitational force of a pool of molten steel 40 cm deep is shown in FIG. 4.

FIG. 3 illustrates slots cut into the rim of the rollers to achieve a low reluctance flux path. These slots can be filled with refractory material or with ferromagnetic material as described in U.S. Pat. No. 4,936,374.

The containment magnet 24 preferably has high relative permeability $\mu_r \geqq 2000$. Its permeability, $\mu=\mu_o\mu_r$, is very much larger than the permeability of the flux-paths through air, the roller rims and the molten metal; all of which have a permeability of $\mu=\mu_o$. Because the containment magnet 24 preferably has laminated ferromagnetic material between its poles 16, the magnetomotive force required to produce flux density $B_{SF1}$ called for by equation (3) can be calculated from the flux path lengths $l_1$,$l_2$ and $l_g$ shown in FIGS. 1 and 2.

The flux path length is $$\Sigma l=2(l_1+l_2)+l_g \quad (4)$$

The required magnetomotive force (MMF) is $$MMF=\Sigma l\frac{B}{\mu_o} \quad (5)$$

Combining (3) and (5) yields $$MMF_{SF1}=k\Sigma l\frac{h^{1/2}}{\mu_o}=421\Sigma l\frac{h^{1/2}}{\mu_o}\text{ for steel} \quad (6)$$

For rollers 10 of 120 cm diameter containing a pool 50 of molten steel 40 cm deep, the magnetomotive force required to produce an electromagnetic force equal to the gravitational force is shown as the graph labeled $MMF_{SF1}$ in FIG. 4. Most of the magnetomotive force is needed approximately 10 cm below the surface of the 40 cm pool 50; a field of 1.33 kG must be maintained over an air gap length of 19 cm which, from equation (5), requires 20 kA. At the nip, only 8.4 kA is required where 2.66 kG must be maintained over the gap of 4 cm.

In addition to gravitational forces, the sidewall of the pool 50 of molten metal 12 is also exposed to fluctuating forces caused by the molten metal feed system and roller-induced forces. Therefore, the electromagnetic containment force is usually chosen to be twice as large as the gravitational force resulting in a required flux density of $$B_{SF2} = k(2h)^{1/2} = 421(2h)^{1/2} \text{ for steel} \quad (3')$$

and $$MMF_{SF2} = k\Sigma l \frac{(2h)^{1/2}}{\mu_o} = 421\Sigma l \frac{(2h)^{1/2}}{\mu_o} \text{ for steel} \quad (6')$$

The graph labeled $MMF_{SF2}$ in FIG. 4 shows the ampere-turn requirements. The ratio of peak magnetomotive force (required approximately 25% below the pool surface) to the magnetomotive force required at the bottom of the pool (at the nip) is 28 kA/11.9 kA=2.4.

Referring to the figures, and more particularly to FIGS. 1–3, a twin roller casting apparatus is indicated generally at 5. The apparatus 5 contains and casts molten metal 12 using the rollers 10. The present invention overcomes the problem of large magnetomotive force requirements, particularly about 25% below the surface of a molten metal pool 50, using a ferromagnetic dam 100 as shown in FIG. 4. The ferromagnetic dam 100, shown in FIGS. 5, 6 and 7 reduces the magnetomotive force required for containing the sidewalls of the molten metal pool 50 to values that are not much larger than what is required at a nip 30. In preferred embodiments of the invention, the ferromagnetic dam 100 can include other structures described hereinbelow, but includes at least a ferromagnetic core 101. These magnetomotive force values are shown as a vertical line MMF FMD a line showing magneto motive force for a ferromagnetic dam 100 in FIG. 4 and are described in detail below.

Power losses are proportional to the square of the current. Therefore, the reduction in ampereturn requirements by a factor of $\geqq 2.4$ reduces power losses by a factor of $\geqq (2.4)^2$ or 5.76. The ferromagnetic dam 100 makes it possible to contain deep pools 50 (associated with twin roller casters with relatively large diameter rollers) which previously were impractical due to the magnitude of power losses involved. Power losses have been very large in both the sidewall of the molten metal 12 as well as in the containment magnet of previous designs.

Referring to FIGS. 5, 6 and 7 the length of flux path $l_g$ in FIG. 1 has been greatly reduced to a length equal to $2l_3$ by placing a highly permeable ferromagnetic core, 101, in the pool 50. As shown in FIG. 7, the distance between an edge of core 101 and one of the roller surfaces in contact with the molten metal 12, is $l_3$. Core 101 is sandwiched between water-cooled heatsinks 102 and 103. The heatsinks 102 and 103 can also be cooled in a variety of other conventional ways. The core 101 and heatsinks 102 and 103 are encased by a conventional refractory material, 104, chosen to withstand the temperature and abrasion of the molten metal 12. The ferromagnetic core 101 can be electrically insulated on at least one side from electrical contact with at least one of said heat sinks.

The ferromagnetic dam 100 not only reduces the flux-path-length $l_g$ of useful flux $\phi_1$ but also improves operating efficiency considerably, presumably by reducing leakage flux $\phi_2$ and by eliminating leakage flux $\phi_3$ shown in FIG. 2. By mounting the heatsink 103 of the ferromagnetic dam 100 to the magnet-shield 18 with a good electrical contact, the flux paths for leakage fluxes $\phi_2$ and $\phi_3$ in FIG. 2 can be eliminated. As shown in FIG. 7, all flux leaving pole **16*a* is forced into core 101** and most of this flux is sidewall containing flux $\phi_1$. This feature eliminates considerable eddy current losses caused by $\phi_3$.

Figure 8:
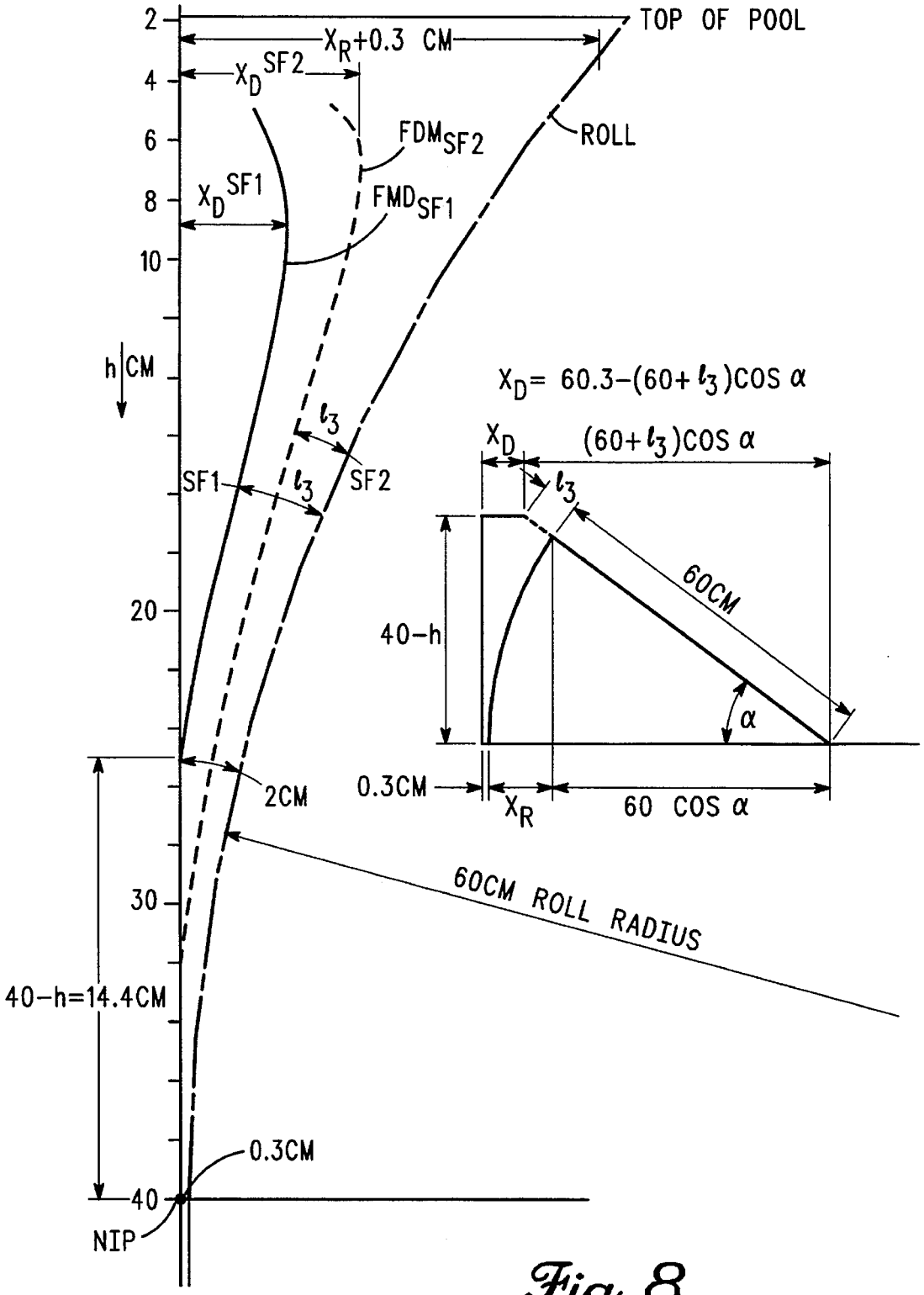
FIG. 8 shows theoretical shapes of ferromagnetic dams to contain a pool of 40 cm of molten steel between two rollers in accordance with one form of the invention.
Figure 10:
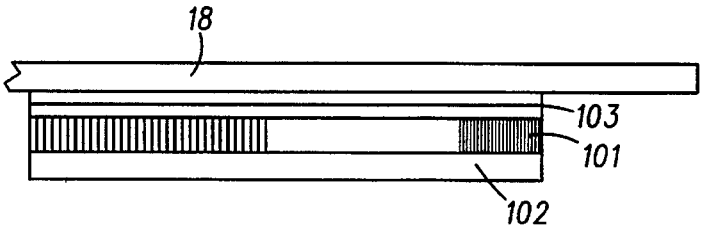
FIG. 10 shows a top view of the ferromagnetic dam embodiments of FIG. 9 in accordance with one form of the invention.

Theoretical shapes for core 101 are shown in FIG. 8. The solid-line shape was calculated as follows:

1. An air gap $l_3$=2 cm was chosen at the bottom of core 101 to provide for 1 cm-wide refractory material 104 and for 1 cm-wide space for the molten metal 12.

2. Angle α, between the horizontal line through the nip 30 and where the bottom of core 101 intersects the 62 cm long line from the axis of the roller 10

$$\alpha = \cos^{-1}\frac{60.3}{62} = 13.5°$$

3. The distance from the nip 30 to the bottom of core 101 is $$40-h=62\text{cm} \sin \alpha=62 \text{ cm} \times 0.233=14.4 \text{ cm}$$

$$h=40-14.14=25.6 \text{ cm}$$

4. The fixed air gaps $l_1$ and $l_2$ (for exemplary purposes and shown in FIG. 7) have lengths of 0.5 cm and 1.2 cm respectively. With $l_3$ chosen as 2 cm at the bottom of core 101, $\Sigma l=2\ (l_1+l_2+l_3)=7.4$ cm. Therefore, the required magnetomotive force is, from equation (6):

$$MMF_{SF1} = 421 \times 7.4 \sqrt{25.6}\ /1.26 = 12.5\ kA$$

producing a field of 421 $\sqrt{25.6}$=2.13 kG. With one excitation coil common to all magnet core sections, the magnetomotive force of 12.5 kA must be equal or larger than the magnetomotive force required at the bottom of the pool 50 where $\Sigma l=2(0.5+1.2+0.3)=4$ cm, $$MMF_{SF1}^{NIP}=421\times4\times\sqrt{40}/1.26=8.5 \text{ kA}<12.5 \text{ kA}$$

5. The separation, $l_3$, between the core 101 and the roller 10 can be calculated for any pool 50 depth, h, from $$2l_3 = \frac{MMF \times \mu_o}{B} - 2(l_1 + l_2) = \frac{MMF \times \mu_o}{kh^{1/2}} - 2(l_1 + l_2) \quad (7)$$

And the width, 2×D, of core 101 from $$X_D=60.3-(60-l_3) \cos \alpha \quad (8)$$

where $$\alpha = \sin^{-1}\frac{40-h}{60+l_3}$$

A safety factor of two, SF2, can be achieved with the same magnetomotive force of 12.5 kA if the separation, $l_3$, between core 101 and rollers 10 is reduced as shown by the dashed curve in FIG. 8. If this is not practicable because of considerations for the refractory material 104 and the flow of the molten metal 12, then the magnetomotive force must be increased to achieve SF2.

Figure 9:
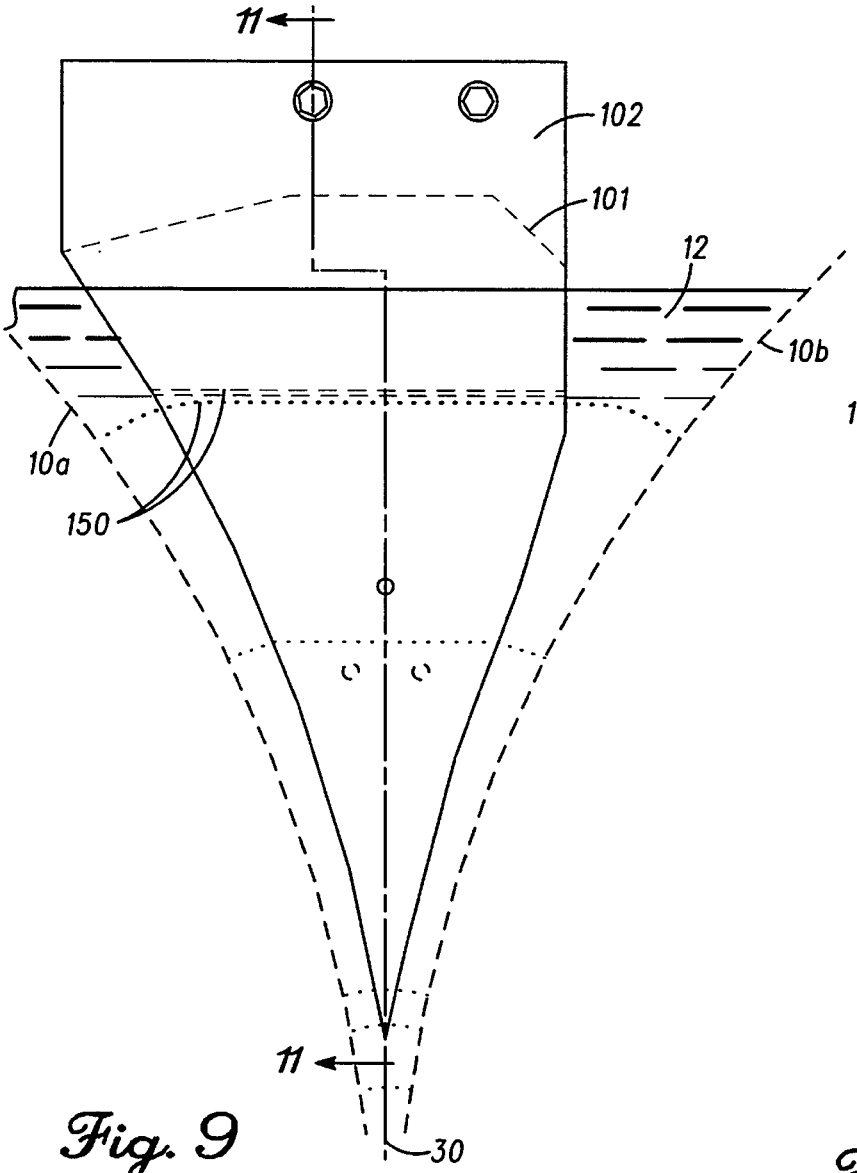
FIG. 9 illustrates a front view showing two ferromagnetic dam embodiments of this invention without a refractory cover.

For many practical applications, the ferromagnetic dam 100 can be dimensioned differently from the theoretical curves shown in FIG. 8. For example, the right half of FIG. 9 illustrates an approximation of part of the curve of FIG. 8 with straight lines. On the left half of FIG. 9, core 101 follows a radius which has its origin at the vertical center line of roller 10 but above the horizontal center line of roller 10 resulting in a separation, $l_3$, between roller 10 and the ferromagnetic dam which increases toward the surface of the pool 50.

Figure 12:
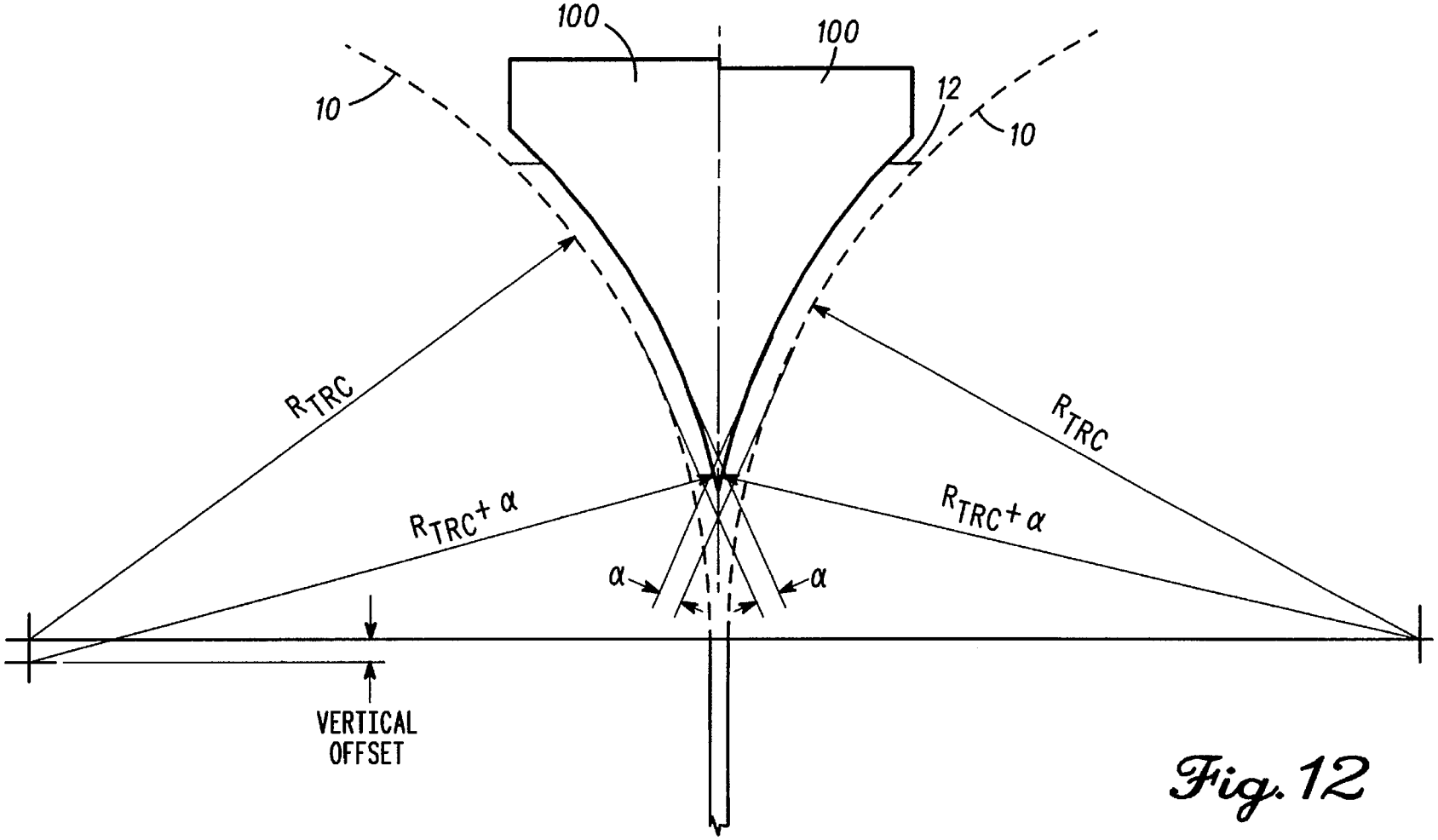
FIG. 12 shows a front view of two other ferromagnetic dam embodiments of the present invention.

Another preferred embodiment of the invention is shown in FIG. 12. This embodiment minimizes eddy-current losses in the sidewall of the pool 50 by exposing as small an area of the sidewall of the pool 50 to the alternating magnetic fields as practicable. The gap at the bottom of the ferromagnetic dam 100 is made as small as possible, consistent with sufficient thickness of the refractory material 104 and the flow of the molten metal 12. In the embodiment shown on the right half of FIG. 12, the shape of the ferromagnetic dam 100 follows a radius which has the same origin as the radius of the roller 10, thereby keeping the gap between ferromagnetic dam 100 and roller 10 constant.

In the embodiment shown on the left half of FIG. 12, the shape of the ferromagnetic dam 100 follows a radius which has its origin on the vertical center line of the roller 10 but below the horizontal center line of the roller 10 causing the gap between ferromagnetic dam 100 and roller 10 to become smaller as one gets closer to the surface of the pool 50. The smaller gap near the surface of the pool 50 does not interfere with the flow of the molten metal 12, because the build-up of solidified metal on the roller 10 is smaller near the top of the pool 50 as compared to the buildup near the bottom of the ferromagnetic dam 100. The result is an electromagnetically contained sidewall surface that is smaller than the one shown in the right half on FIG. 12.

Figure 16:
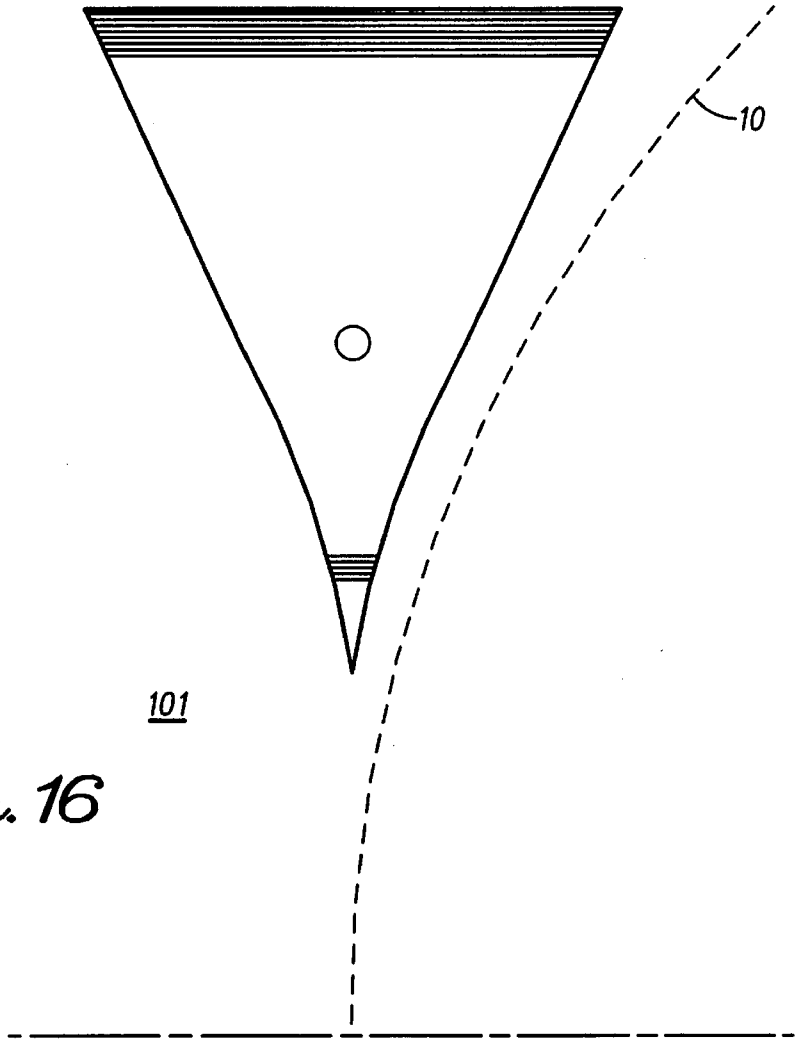
FIG. 16 shows a front view of the core 101 of the ferromagnetic dam shown in FIG. 13.
Figure 19:
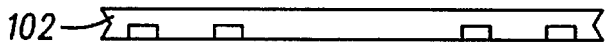
FIG. 19 illustrates a top view of heatsink 102 of the ferromagnetic dam shown in FIG. 13.
Figure 18:
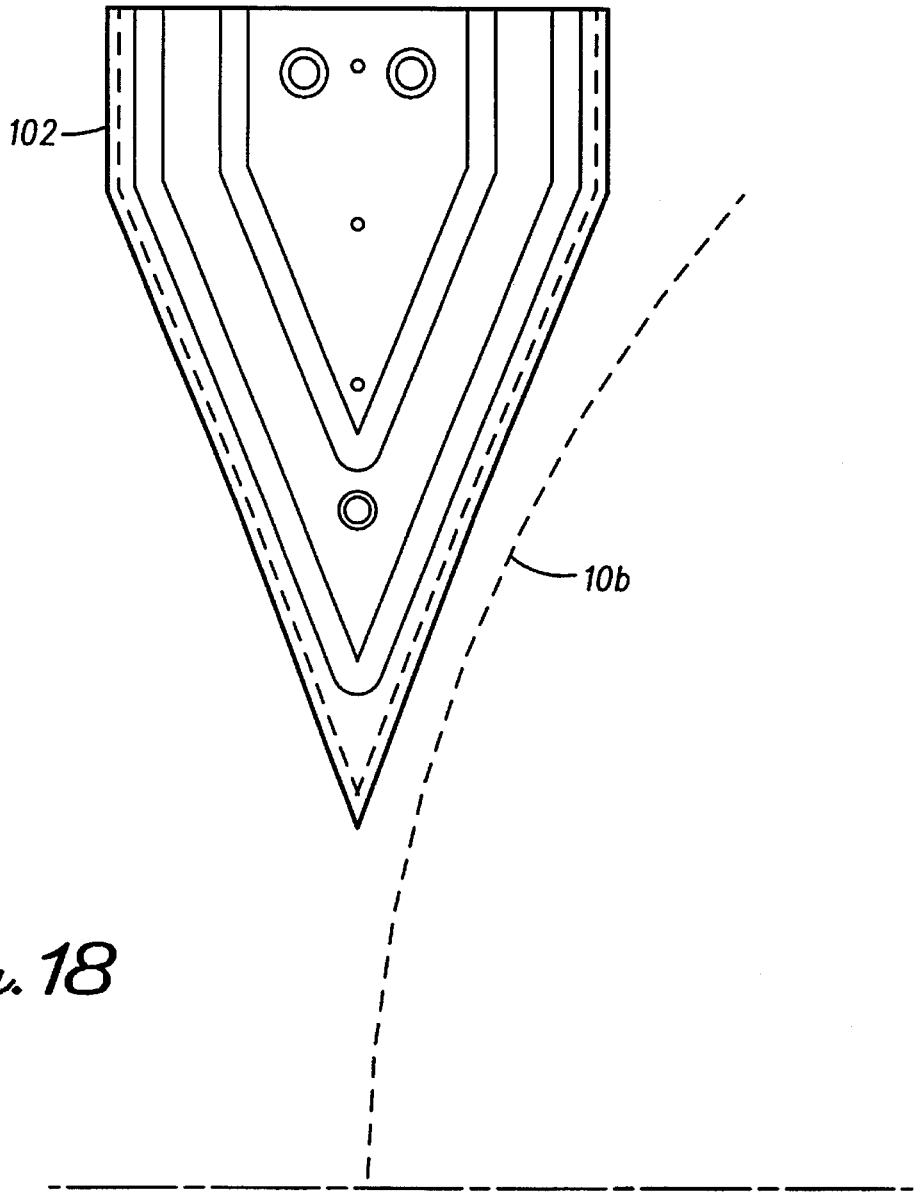
FIG. 18 shows a front view of heatsink 102 of the ferromagnetic dam shown in FIG. 13.
Figure 21:
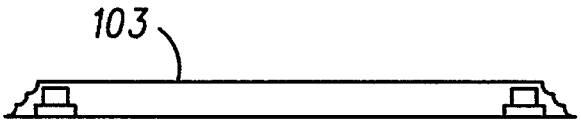
FIG. 21 illustrates a top view of heatsink 103 of the ferromagnetic dam shown in FIG. 13.
Figure 20:
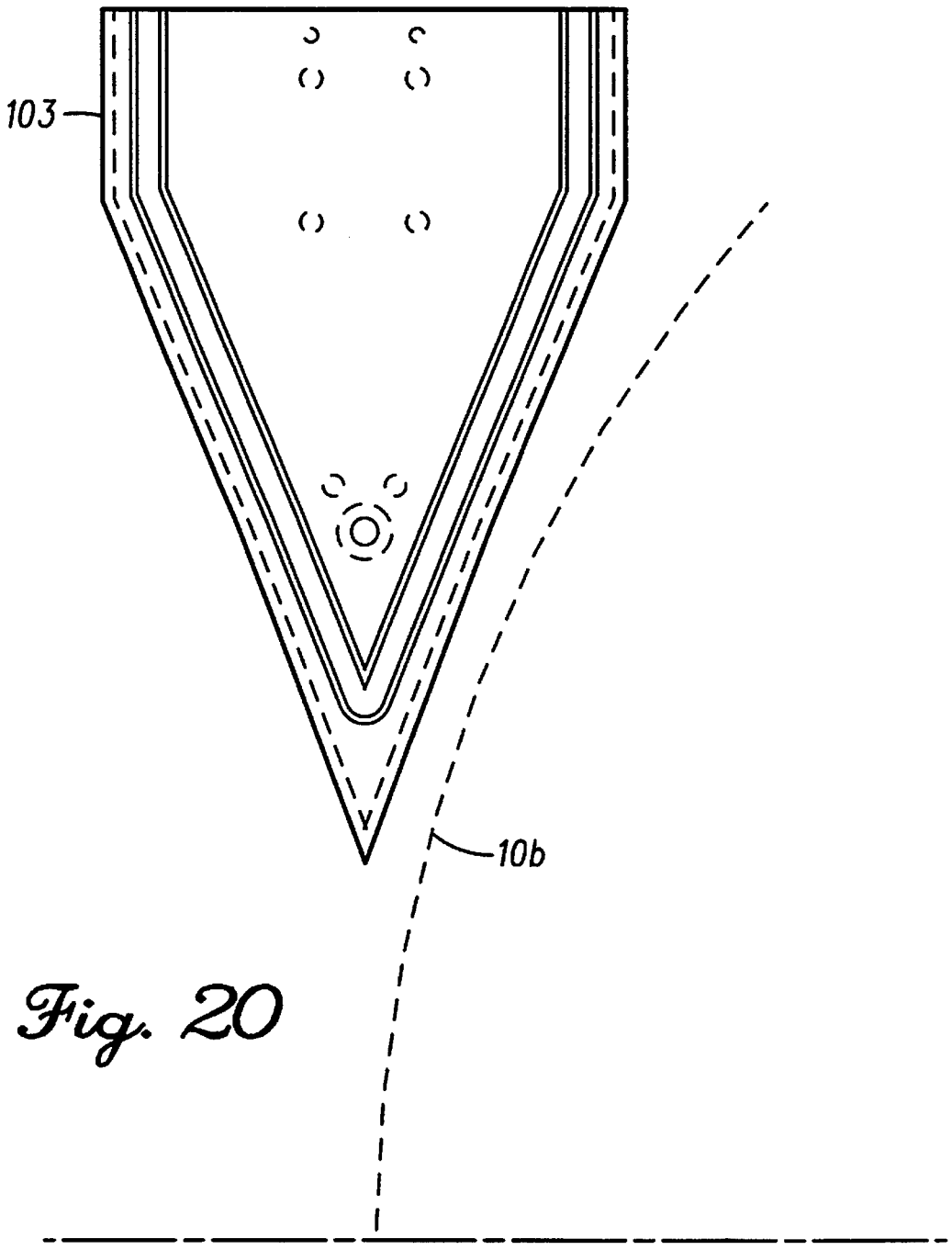
FIG. 20 shows a front view of heatsink 103 of the ferromagnetic dam shown in FIG. 13.

In the embodiment of the invention shown in FIGS. 13–21, the bottom part of core 101 and heatsinks 102 and 103 follows a radius that is larger than the radius of each of the rollers 10 by a dimension that assures both sufficient space for refractory material 104 and that the molten metal 12 can flow in the gap between the roller 10 and the ferromagnetic dam 100. This radius is followed 109.5 millimeters above the tip of core 101 by a straight line which is the tangent to the radius; the point where the radius and tangent meet is chosen to suit the specific twin roller caster (rpm's of rollers, molten metal-feed system, etc.). The tangent lines turn horizontal 2 cm above the top of the 40 cm pool 50 as shown in FIG. 16.

Figure 11:
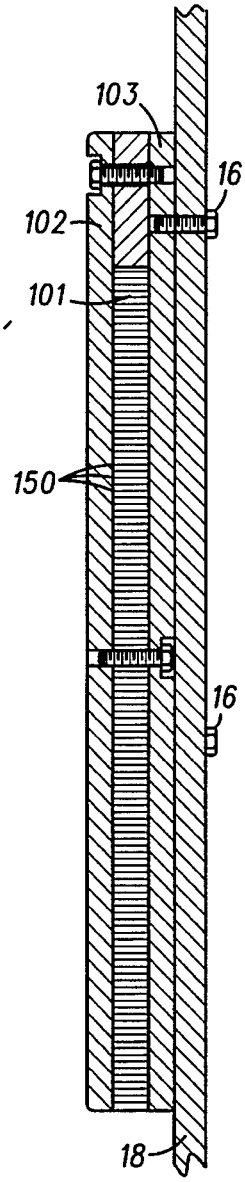
FIG. 11 illustrates a cross sectional view along line 11—11 of FIG. 9.
Figure 17:
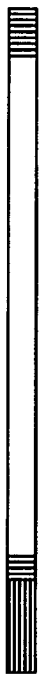
FIG. 17 illustrates a side view of the core 101 of the ferromagnetic dam shown in FIG. 13.

The core 101 of the ferromagnetic dam 100 can be made from high temperature ferrite or from laminations 150 made from amorphous ferromagnetic material or from silicon steel. Ferromagnetic laminations 150 can be arranged vertically or horizontally. A horizontal orientation as shown in FIGS. 11, 16 and 17 is preferred in order to control the flux path as illustrated in FIG. 9. Preferably, the entire ferromagnetic core 101 comprises horizontally-oriented laminations 150 as shown in FIG. 11. For laminations 150 made from grain-oriented silicon steel, the grain orientation should also be in a horizontal direction.

Figure 14:
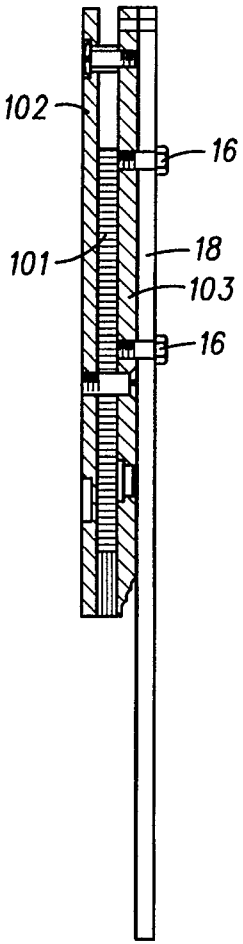
FIG. 14 shows a view along line 14—14 of FIG. 13.
Figure 15:
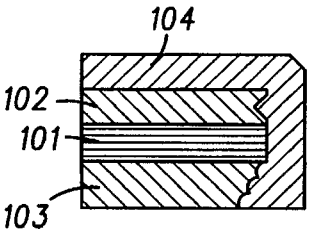
FIG. 15 illustrates a view along line 15—15 of FIG. 13.
Figure 13:
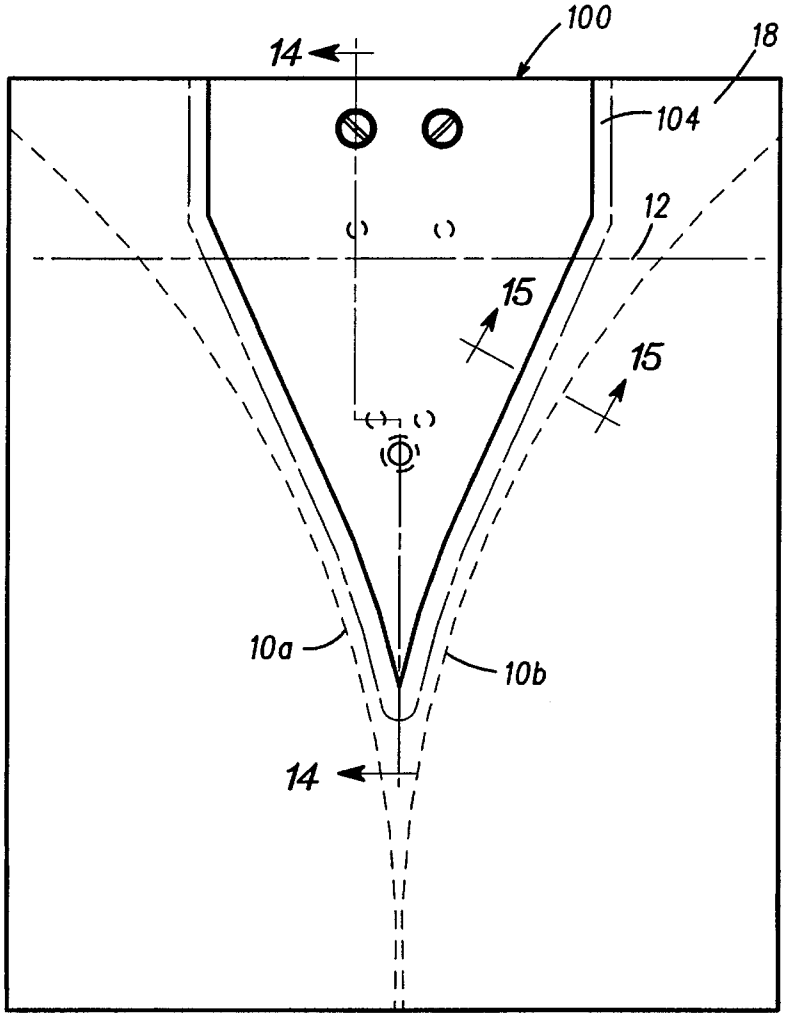
FIG. 13 illustrates a front view of another embodiment of the present invention.

The laminations 150 for core 101 can also be arranged vertically as shown in the lower parts of FIGS. 14, 16 and 17. Vertical laminations 150 have the disadvantage that the flux path generally cannot be controlled as well as with horizontal laminations 150. For example, flux entering where the gap, $l_3$, between ferromagnetic dam 100 and the roller 10 is wide (near the top of the pool 50 shown in FIG. 8) passes down through the vertical laminations 150. From these vertical laminations 150, the flux emerges on the other side of core 101 where the gap is smaller (flux seeks the path of lowest reluctance).

The use of vertical lamination techniques for a small section of core 101 as shown in the embodiments of the invention shown in FIGS. 14, 16 and 17 is an exception for the use of vertical laminations 150. In some preferred embodiments of the invention, it can be useful to machine the bottom portion of core 101 from a subassembly of vertical laminations 150 because they are, as a rule, easier to machine to a narrow dimension (or to a sharp point) than is an assembly of horizontal lamination 150. This relatively small section of core 101, however, is only a few centimeters high and does not cause much flux distortion.

Another preferred embodiment of the invention is shown in FIG. 22 and uses beveled sidewalls 152 to enhance flow of the molten metal 12. The molten metal 12 is pushed back by the magnetic field between roller 10 and core 101 until the electromagnetic force balances the gravitational force. The magnetomotive force is selected to have a value that assures that molten metal 12 cannot penetrate the magnetic field so far that it would be next to water-cooled heatsink 103 during normal operation. Therefore, heatsink 103 has straight sidewalls 154. Only the ferromagnetic core 101 and water-cooled heatsink 102 have beveled sidewalls 152 to enhance flow of the molten metal 12 and, therefore, permit smaller gaps between these beveled edges and the rollers 10. The beveled sidewalls 152 of the core 101 and the heatsink 102 can have the same angle or their sides can be beveled with different angles.

In another preferred embodiment of the invention, only the core 101 is beveled and both heatsinks 102 and 103 have straight sidewalls 154. Alternatively, only the top heatsink 102 is beveled and the core 101 and the bottom heatsink 103 have straight sidewalls 154. A beveled sidewall 152 on core 101 increases the flux density as the molten metal 12 moves axially from the bottom of heatsink 102 to the top of heatsink 103. This has the desirable effect that the electromagnetic containment force also increases proportional to the square of flux density as shown by equation (2).

Very little electromagnetic containment force is required near the top of the pool 50. Therefore, the core 101 of the ferromagnetic dam 100 need not extend much beyond the surface of the pool 50. However, in many applications it is advantageous to extend core 101 well beyond the normal pool heights in order to contain fluctuations in pool heights due to transients in the molten metal-feed-system. For this reason, the ferromagnetic dams of FIGS. 9–18 and 20 extend above the surface of the pool 50 of molten metal 12.

Extending core 101 beyond the surface of the pool 50 and having the core 101 width, $2X_D$, much wider than what would be required from equation (8) results in electromagnetic containment forces much larger than what would be required for sidewall containment near the surface of the pool 50. This, however, does not result in excessive push-back of the molten metal nor in excessive losses. As illustrated in FIG. 7, the shape of the magnetic field in the gap between the rollers 10 and the ferromagnetic dam 100 is determined by the reluctance of the rim of the roller 10, the skin depth of the molten metal 12 and by the thickness, D, of the core 101 of ferromagnetic dam 100. If the magnetic field is much larger than what is required for sidewall containment, then the molten metal 12 is pushed back further from the edge of the rollers 10. However, this push-back is limited because the electromagnetic field drops off sharply with distance from the edge of the rollers 10 for two reasons. First, flux cannot penetrate the rollers 10 deeper than about a skin depth below the bottom of slots 13 a cut into the edge of the roller 10 as shown in FIGS. 3 and 7. Secondly the containment flux can only return via the laminations of core 101 which are limited to a build-up of thickness D as shown in FIG. 7. For most applications, thickness D is made the same as the skindepth $\delta_{MM}$ of the molten metal.

$$\delta_{MM} = \left(\frac{\rho}{\pi\mu f}\right)^{1/2} \tag{9}$$

where f=frequency of alternating magnetic field.

Within one skindepth, $\delta_{MM}$, of the molten metal 12, flows 63% of the flux that bridges the gap between roller 10 and core 101. Therefore, it is a good compromise if the thickness of core 101 is made equal to the skindepth, $D=\delta_{MM}$. With $D>>\delta_{MM}$ the thickness of ferromagnetic dam 100 is increased and with it the depth of the gap between rollers 10 which can interfere with the flow of molten metal 12. Furthermore, with $D>>\delta_{MM}$, the ferromagnetic dam 100 and the ferromagnetic core material 101 are not used efficiently. With $D<<\delta_{MM}$ the flux density in the core 101 increases and with it core losses; e.g., the core losses at 3kHz increase from 6.2 W/lb to 55 W/lb if the flux density is increased from 3 kG to 10 kG in grain-oriented silicon. The core 101 should be operated at flux densities which are much less than the saturation flux density of the core material which is ≦19 kG for grain oriented silicon steel and <5 kG for most ferrites.

For best results, the refractory material 104 enclosing the core 101 and heatsinks 102 and 103 as illustrated in FIGS. 6, 7, 13, and 22, should be compatible with the molten metal 12 both chemically and with respect to thermal expansion characteristics. For steel, with a temperature of approximately 1540° C. in its liquid state, CERAMACAST® 505 (max. temp. 1760° C.) or other ceramic material capable of withstanding high temperatures can be used. The build-up of the refractory material 104 is kept as small as practicable. The refractory material 104 must be replaced after extended casting runs because of wear, tear and cracks. For that purpose ferromagnetic dam 100 is preferably made readily removable from magnet shield 18 by unbolting bolts 16 shown in FIGS. 11 and 14. After the worn refractory material 104 has been removed, the assembly of core 101 sandwiched between heatsinks 102 and 103 is placed in a mold and a new refractory coat 104 is cast on it. To improve adhesion between the refractory material 104 and heatsinks 102 and 103, the surface of the heatsinks 102 and 103 can be roughened, or grooves and/or beveled edges can be placed into the surface as shown in FIGS. 14, 15, 19 and 21.

In another embodiment of the invention, shown in FIG. 23, the refractory material 104 comprises more than one cast layer 106. The cast layer 106 next to the heatsinks 102, 103 and core 101 is designed to last for many casting runs. It is covered by a replaceable refractory heat shield 108 cemented to it. In another embodiment the refractory heat shield 108 is cast to such dimensions that it need not be cemented to inner refractory cast layer 106 but slips over the cast layer 106 and is fastened to the ferromagnetic dam 100 by mechanical fasteners such as screws, bolts or clips. The mechanical fasteners for securing the replaceable refractory heat shield 108 to the ferromagnetic dam 100 subassembly can be located in the section of the ferromagnetic dam 100 which is above the pool 50 of molten metal.

In still another embodiment of the invention, the refractory heat shield 108 is cast separately to match the subassembly 110 of core 101 and heatsinks 102 and 103. It is preferably mechanically fastened to the subassembly 110 and readily replaceable between casting runs as required.

Containment magnets 24 made from continuous ferromagnetic material and energized from one coil can produce flux densities along the vertical surface of the sidewall of the molten metal 12 that cause too much push-back and/or eddy-current-losses at some portions of the sidewall. In accordance with another embodiment of this invention, this problem is solved by providing parallel, independently adjustable magnetic elements as described in U.S. Pat. No. 4,936,374 (particularly in FIG. 10 and claim 21) and a ferromagnetic dam 100 with horizontal laminations which will permit magnetic flux to path through the ferromagnetic dam 100 only in a horizontal path. In this embodiment, one independently adjustable magnetic element controls the flux that flows below the ferromagnetic dam 100 (between the nip 30 and the bottom of the ferromagnetic dam 100). A second independently adjustable magnetic element controls the flux flowing in the lower portion of the ferromagnetic dam 100. A third (and possibly fourth) independently adjustable magnetic element can control the flux in the upper portion of the ferromagnetic dam 100. Similar results can be obtained with a ferromagnetic dam 100 with horizontal laminations paired with a one-coil magnet which has shielded cores with adjustable gaps for reluctance control as shown in FIGS. 47, 48 and 49 of U.S. Pat. No. 5,251,685. The horizontal laminations 150 of the ferromagnetic dam 100, which restrict the magnetic flux to a horizontal plane, make it possible to extend the significant electromagnetic controls described in the above United States patents to be extended to a containment apparatus utilizing a ferromagnetic dam 100. If the core 101 of the ferromagnetic dam 100 is made from ferrite or from vertical laminations, the features of the above United States patents cannot be fully realized, presumably because flux can transfer within the ferromagnetic dam 100 from one horizontal plane to another; thereby negating the control of flux distribution in the sidewall of the molten metal 12 and with it the control of the sidewall containment.

While preferred embodiments of the invention have been shown and described, it will be clear to those skilled in the art that various changes and modifications can be made without departing from the invention in its broader aspects as set forth in the claims provided hereinafter.

What is claimed is:

1. Apparatus for casting sheets of metal from molten metal, comprising:

a containment means having an open side;

horizontal alternating magnetic field production means for containing molten metal in at least a first portion of said open side with an electromagnetic force; and a dam comprising a ferromagnetic material disposed adjacent said open side, said dam containing molten metal from leaking from at least a second portion of said open side.

2. The apparatus as defined in claim 1, wherein said containment means comprises counter rotating rollers spaced apart and defining said open side.

3. The apparatus as defined in claim 1, wherein said horizontal alternating magnetic field production means includes a pair of substantially horizontally spaced magnet poles.

4. The apparatus as defined in claim 1, further including a layer refractory material secured to said dam on at least one side of said dam on which the molten metal can be contained.

5. The apparatus as defined in claim 1, wherein at least a portion of said dam comprises ferromagnetic laminated material with laminations disposed along a substantially horizontal axis to force the flux lines along the axis.

6. Apparatus for casting sheets of metal from molten metal, comprising:

counter rotating rollers spaced apart and defining a gap between said rollers;

a ferromagnetic dam adjacent said rollers for mechanically and electromagnetically containing at least some of the molten metal;

a magnet capable of generating a substantially horizontal alternating magnetic field, said magnet including magnetic poles located adjacent said rollers; and said magnet comprising means for inducing eddy currents in a layer substantially at the surface of molten metal with said magnet, said eddy currents interacting with the magnetic field producing a force for containing molten metal.

7. A magnetic containment apparatus for preventing escape of molten metal through an open side of a gap between two spaced members and between which the molten metal is located, said apparatus comprising:

a magnetic core;

an electrically conductive coil capable of energizing said magnetic core;

said magnetic core comprising a pair of horizontally disposed, spaced magnet poles disposed adjacent the open side of said spaced members for generating a substantially horizontal magnetic field which extends through the open side of said gap to the molten metal;

a non-magnetic, electrically conductive shield disposed between the magnet poles adjacent to the open side of said gap; and a ferromagnetic dam mounted to said electrically conductive shield and extending into the gap between said spaced members, thereby providing a low reluctance flux path for said horizontal magnetic field.

8. The apparatus as defined in claim 7, wherein a ferromagnetic core of said ferromagnetic dam is disposed between two heatsinks, said ferromagnetic core and said heatsinks further having portions covered by a refractory material, thereby enabling said ferromagnetic core to operate below its Curie-temperature when said ferromagnetic dam is in contact with the molten metal.

9. The apparatus as defined in claim 8, wherein an interface of said ferromagnetic core with one of said heatsinks mounted to said shield is located past sidewalls of said spaced members resulting in deeper push-back of the molten metal.

10. The apparatus as defined in claim 7, wherein at least a portion of said dam comprises ferromagnetic laminated material with laminations disposed along a substantially horizontal axis to force flux lines along the axis.

11. The apparatus as defined in claim 7, wherein at least a tip portion of said dam comprises ferromagnetic laminated material with laminations disposed along a substantially vertical axis.

12. The apparatus as defined in claim 8, wherein a ferromagnetic core of said ferromagnetic dam is electrically insulated on at least on one side from electrical contact with at least one of said heatsinks.

13. The apparatus as defined in claim 8, wherein surfaces of said heatsinks in contact with said refractory material are modified to enhance adhesion between said refractory material and said heatsinks.

14. The apparatus as defined in claim 8, wherein said heatsinks and said ferromagnetic core of said ferromagnetic dam have straight sides.

15. The apparatus as defined in claim 8, wherein said heatsinks and said ferromagnetic core of said ferromagnetic dam have beveled sides.

16. The apparatus as defined in claim 8, wherein said heatsinks have straight sides and where said ferromagnetic core has-beveled sides.

17. The apparatus as defined in claim 8, wherein said ferromagnetic core and said heatsink closest to the molten metal have beveled sides and said heatsink next to said shield has straight sides.

18. The apparatus of claim 7 wherein said heatsinks and said ferromagnetic core are enclosed at least in part by a cast structure of said refractory material.

19. The apparatus as defined in claim 8, wherein said refractory material is cast separately and secured to said ferromagnetic dam for ease of replacement.

20. The apparatus as defined in claim 8, wherein a thin semi-permanent refractory coating is cast on the ferromagnetic dam and a second replaceable refractory coating is mechanically fastened over it.

21. The apparatus as defined in claim 7, wherein a separation between sides of said ferromagnetic dam and said spaced members at any point is chosen such that the safety factor for sidewall containment at any part of the pool of molten metal increases as one moves from the tip of said ferromagnetic dam to the top of the pool of molten metal.

22. The apparatus as defined in claim 7, wherein a sidewall of said ferromagnetic dam follows a radius that is on the vertical center line of the closest of said spaced members, and above the horizontal centerline of said closest spaced member, resulting in a separation between said ferromagnetic dam and said spaced member which increases toward the top of the pool of molten metal.

23. The apparatus as defined in claim 7, wherein a sidewall of said ferromagnetic dam follows a radius that originates substantially at the axis of a closer one of said spaced members resulting in a separation between said ferromagnetic dam and said closer spaced member that remains substantially constant.

24. The apparatus as defined in claim 7 wherein a separation between sides of said ferromagnetic dam and said spaced members at any point is chosen such that the safety factor for sidewall containment at any point of the pool of molten metal remains about the same as one moves from the tip of said ferromagnetic dam to the top of the pool of metal.

* * * * *